US012152786B1

(12) United States Patent
Nolton et al.

(10) Patent No.: US 12,152,786 B1
(45) Date of Patent: Nov. 26, 2024

(54) FIREPLACE WITH FLAME JUMPING SEQUENTIAL LOG LIGHTING

(71) Applicant: Modern Flames, LLC, Phoenix, AZ (US)

(72) Inventors: Jim Nolton, Scottsdale, AZ (US); Elliott White, Chandler, AZ (US)

(73) Assignee: MODERN FLAMES, LLC., Phoenix, AZ (US)

( * ) Notice: Subject to any disclaimer, the term of this patent is extended or adjusted under 35 U.S.C. 154(b) by 0 days.

(21) Appl. No.: 18/387,353

(22) Filed: Nov. 6, 2023

(51) Int. Cl.
*F24C 3/00* (2006.01)
*F24B 1/19* (2006.01)
*F24B 1/18* (2006.01)

(52) U.S. Cl.
CPC ..... *F24C 3/006* (2013.01); *F24B 1/1808* (2013.01)

(58) Field of Classification Search
None
See application file for complete search history.

(56) References Cited

U.S. PATENT DOCUMENTS 3,113,611 A * 12/1963 Dupler ..... F24C 3/006 239/211
RE25,987 E * 3/1966 Dupler ..... F24C 3/006 431/328
3,617,159 A * 11/1971 Arndt ..... F23N 5/08 431/50
3,694,137 A * 9/1972 Fichter ..... F23Q 9/045 431/283
4,395,230 A * 7/1983 Berry ..... F24C 3/087 431/286
5,052,370 A * 10/1991 Karabin ..... F24C 3/006 126/92 R
5,655,513 A * 8/1997 Whitfield ..... F24C 3/006 126/92 AC
6,383,421 B1 * 5/2002 Phipps ..... F24C 3/006 264/46.7
2003/0039933 A1 * 2/2003 Lyons ..... C04B 28/24 431/125
2003/0198908 A1 * 10/2003 Berthold ..... F24C 3/006 431/278
2007/0235020 A1 * 10/2007 Hills ..... F23N 1/002 126/512
2013/0288187 A1 * 10/2013 Imgrundt ..... F23D 14/46 431/278

FOREIGN PATENT DOCUMENTS

DE 202005021800 U1 * 4/2010 ..... F23D 14/02
GB 1486640 A * 9/1977 ..... F24C 3/006

* cited by examiner

*Primary Examiner* — Jorge A Pereiro
(74) *Attorney, Agent, or Firm* — CM LAW PLLC; Robert C. Klinger

(57) ABSTRACT

A fireplace having a plurality of faux logs sequentially lit using a single ignitor and flame jumping between the faux logs. The ignitor ignites a first faux log, which after a time period ignites a neighboring second faux log. After another time period, the second faux log ignites a neighboring third faux log and so on. The sequentially lighting of the faux logs creates an aesthetically pleasing lighting sequence, and also a pleasing sequential lighting sound. The faux logs are individually supported by a respective conduit over media disposed on an ember bed and which individually supplies gas to the respective faux log.

14 Claims, 9 Drawing Sheets

FIREPLACE WITH FLAME JUMPING SEQUENTIAL LOG LIGHTING

TECHNICAL FIELD

The present disclosure relates to fireplaces that generate flames for homes, apartments, hotels, commercial buildings, and other confined locations.

BACKGROUND

In-wall fireplaces are commonly used in personal homes, condominiums, apartments and the like to generate a flame when a real log burning fireplace is not allowable or preferred.

This disclosure includes a fireplace designed to eliminate the challenges and disadvantages commonly associated with wood burning fireplaces without compromising the realism of the flames.

DETAILED DESCRIPTION

This disclosure includes a fireplace having a plurality of faux logs sequentially lit using a single ignitor and flame jumping between the faux logs. The ignitor ignites a first faux log, which after a time period ignites a neighboring second faux log. After another time period, the second faux log ignites a neighboring third faux log and so on. The sequentially lighting of the faux logs creates an aesthetically pleasing lighting sequence, and also a pleasing sequential lighting sound. The faux logs are individually supported by a respective conduit over media disposed on an ember bed and which respective conduit individually supplies gas to the respective faux log.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and circuitry have been described at a relatively high-level, without detail, in order to avoid unnecessarily obscuring aspects of the present teachings.

The term "coupled" as used herein refers to any logical, optical, physical or electrical connection, link or the like by which signals, or light produced or supplied by one system element are imparted to another coupled element. Unless described otherwise, coupled elements or devices are not necessarily directly connected to one another and may be separated by intermediate components, elements or communication media that may modify, manipulate or carry the light or signals.

Figure 1:
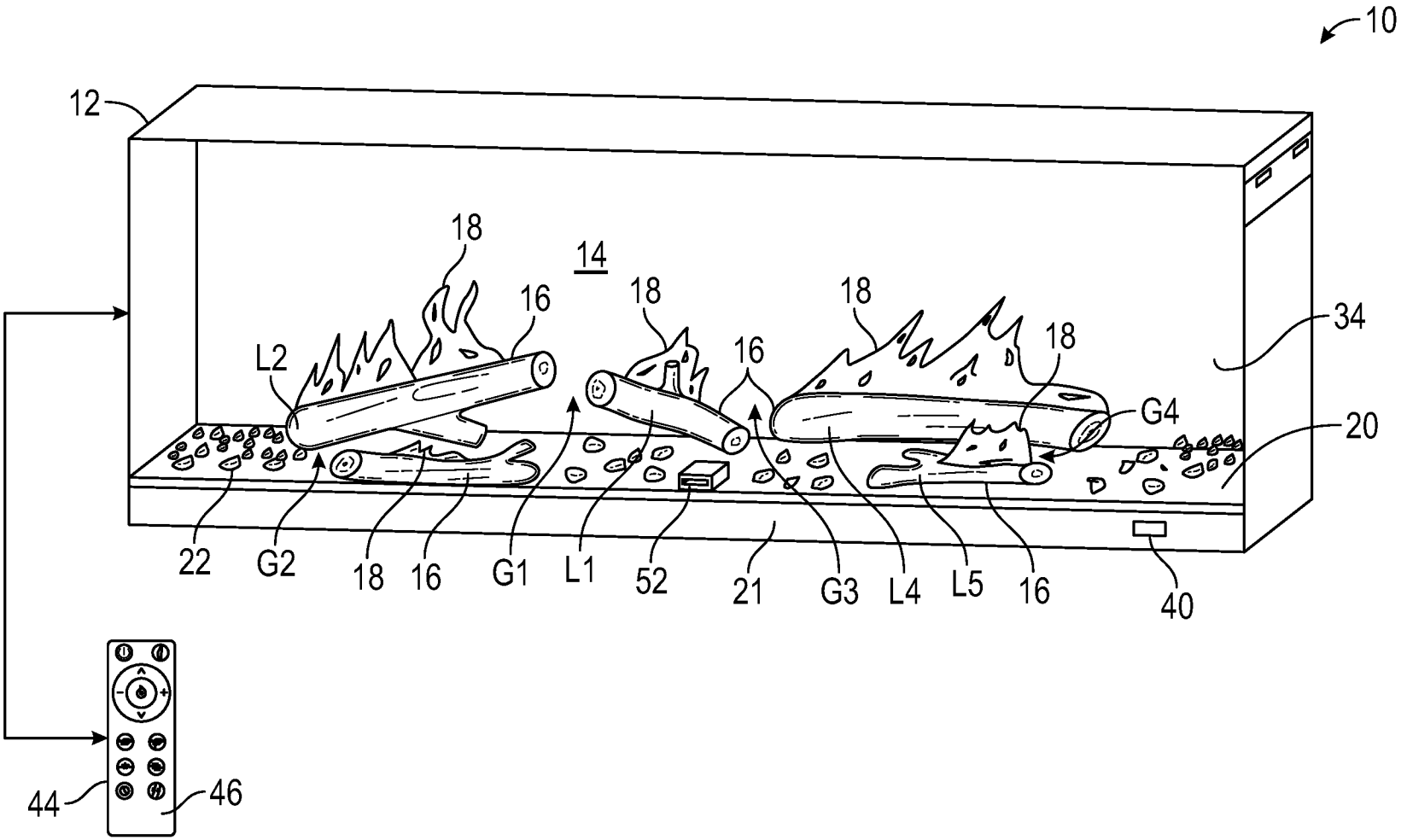
FIG. 1 illustrates a perspective front view of the fireplace including a plurality of faux logs configured to be sequentially lit from a single ignitor by log-to-log flame jumping.

Referring to FIG. 1 there is illustrated a fireplace 10 having a body 12 forming a firebox including a cavity 14, shown as a chassis having a firebox including a plurality of spaced faux logs 16, such as resin faux logs, fiber logs and concrete logs, each generating a respective flame 18. Fireplace 10 has a faux ember bed 20 positioned upon a firebox body 21 at the bottom of fireplace 10. Ember bed 20 is covered by a media 22, such as crushed glass. Ember bed 20 may be formed of a plastic (e.g., Polystyrene or Acrylic) ember bed screen (white color). Body 12 may have a colored glass viewing window 34, such as a tea color, such as tempered glass with sanded edges.

Figure 2:
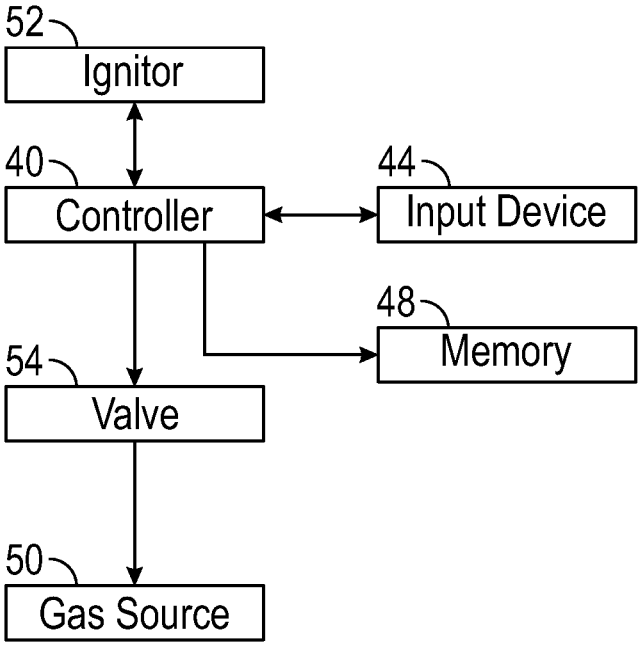
FIG. 2 illustrates the electrical circuitry of the fireplace.

An electrical controller 40 is positioned in the bottom of firebox body 21 and is controllable by a user using a wireless input device 44, such as a remote control having a user interface 46 as shown. In an example, the wireless input device 44 is a wireless smart mobile device with the user interface 46 including a touch display controlled by an application (app) stored in a memory 48, as shown in FIG. 2. The wireless input device 44 can be a smart phone, as well as a smart watch, smart eyewear, a laptop computer, and other such smart devices. The smart mobile devices control the controller 40 using standard communication protocols, such as Wi-Fi and BlueTooth™, but can also communicate via a wireless network including the internet. Controller 40 is configured to control the flow of gas from a gas source 50 to each individual faux log 16 by controlling a valve 54 (FIG. 3).

A single flame ignitor 52 controlled by controller 40 is configured to ignite a flow of gas received via valve 54 at a single point proximate a center faux log L1 as will be discussed below. Each of the other faux logs 16 labeled logs L2-L5 are then sequentially ignited by a flame of a neighboring faux log 16 in a controlled sequence, where a flame jumps or hops from log-to-log over time.

FIG. 2 illustrates the electrical circuitry including controller 40 and memory 48, which memory 48 may be part of the controller 40 configured as a system on a chip (SOC), and the memory 48 may be removable such as a thumb drive. The memory 48 can also be changed and updated wirelessly via wireless input device 44 or another network device, such as using the internet or BlueTooth™, such as to perform an update and to add new control features, such as provide new flame ignition sequences. Controller 40 is configured to control the flow of gas from gas source 50 to flame ignitor 52, a position of valve 54, and flame ignitor 52. Opening valve 54 allows the flow of gas to flame ignitor 52.

Figure 3:
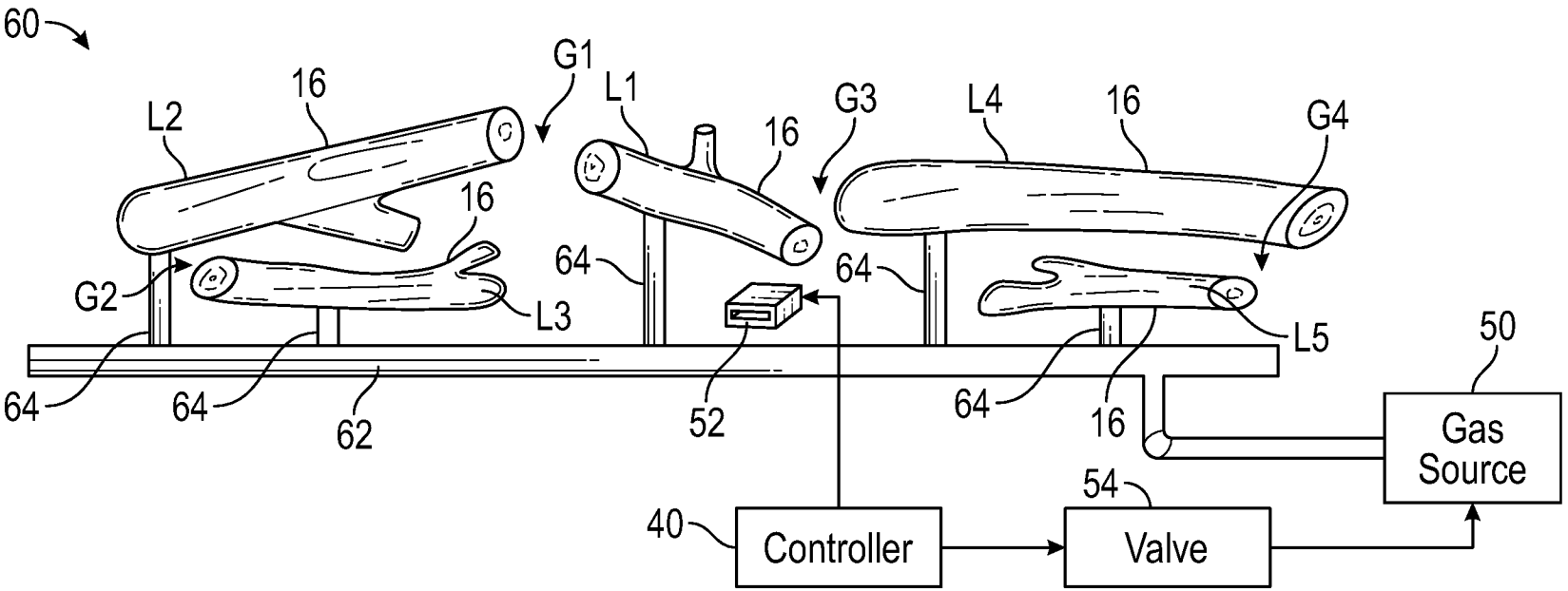
FIG. 3 illustrates a gas plumbing system of the fireplace.

FIG. 3 illustrates a gas plumbing system 60 configured to individually supply gas, such as natural gas, from gas source 50 along gas conduit 62 to each faux log 16 via a dedicated gas conduit 64 of the respective faux log 16. The gas conduit 62 is hidden in media 22.

Figure 4:
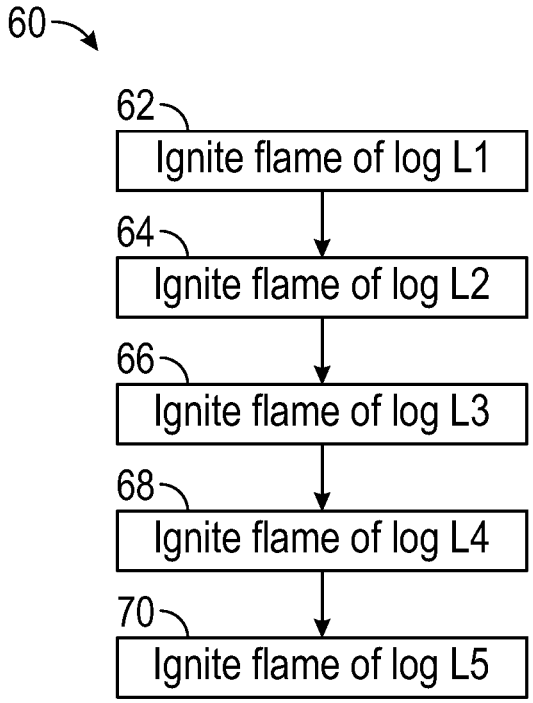
FIG. 4 illustrates a faux log lighting sequence and is described with reference to FIG. 3.

FIG. 4 illustrates a faux log lighting sequence 60 as described with reference to FIG. 3.

Figure 5A:
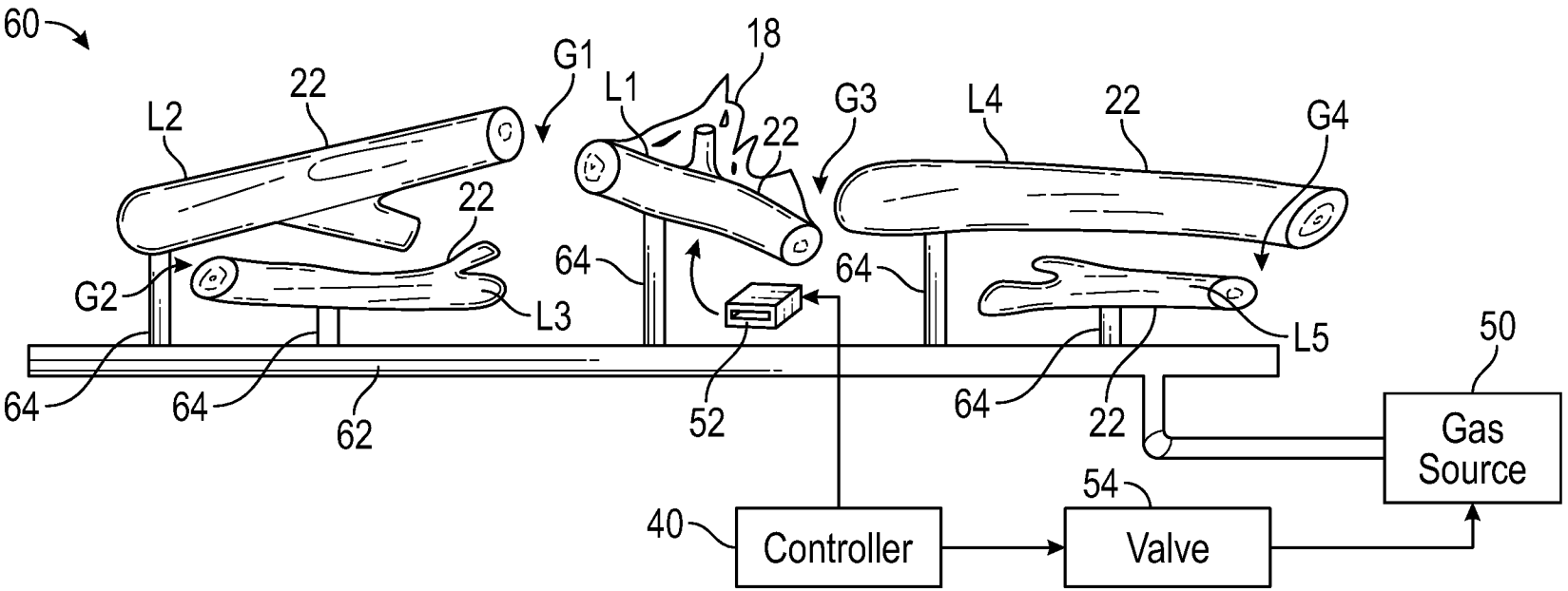
FIG. 5A-FIG. 5E illustrate sequential lighting of the faux logs using flame jumping.
Figure 5B:
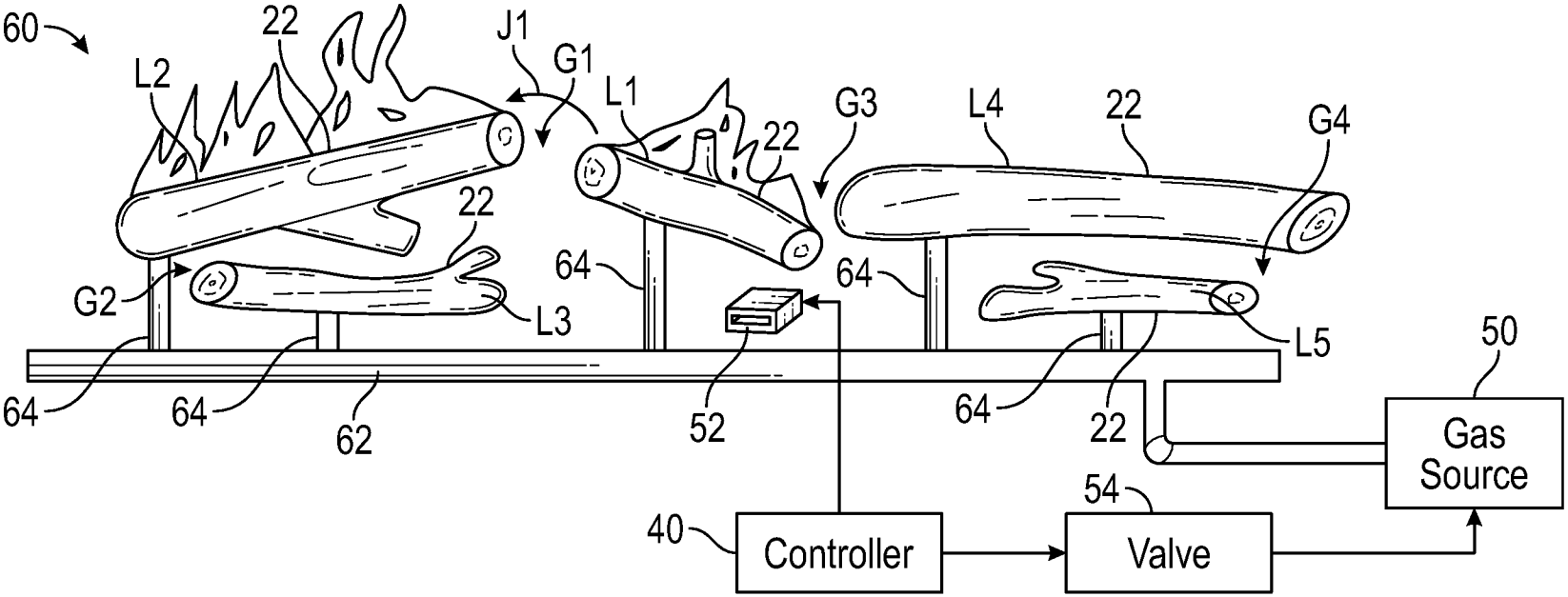

At block 62, upon user instruction of faux fireplace 10 to turn on using wireless input device 44, controller 40 controls valve 54 to open which allows gas to begin flowing from gas source 50 to the single ignitor 52. After a time period, controller 40 controls ignitor 52 by sending an electrical control signal such that ignitor 52 ignites the gas supplied to the center faux log 16, labeled faux log L1, to ignite faux log L1. This is visually shown in FIG. 5A.

At block 64, after a first time period, such as 0.5 seconds, the flame 18 of faux log L1 communicates through a respective conduit 64, such as a tube extending within the body of faux log L1 along a length thereof, and ignites gas supplied via respective conduit 64 of faux log L2 by jumping a gap G1 extending between an end of faux log L1 to an opposing end of faux log L2, shown as jump J1, thereby igniting faux log L2. This flame jumping is visually shown at J1 in FIG. SB. This flame jumping across gap G1 between the respective faux logs is also referred to herein as flame hopping. The first time period is determined by the spacing distance between faux log L1 and faux log L2.

Figure 5C:
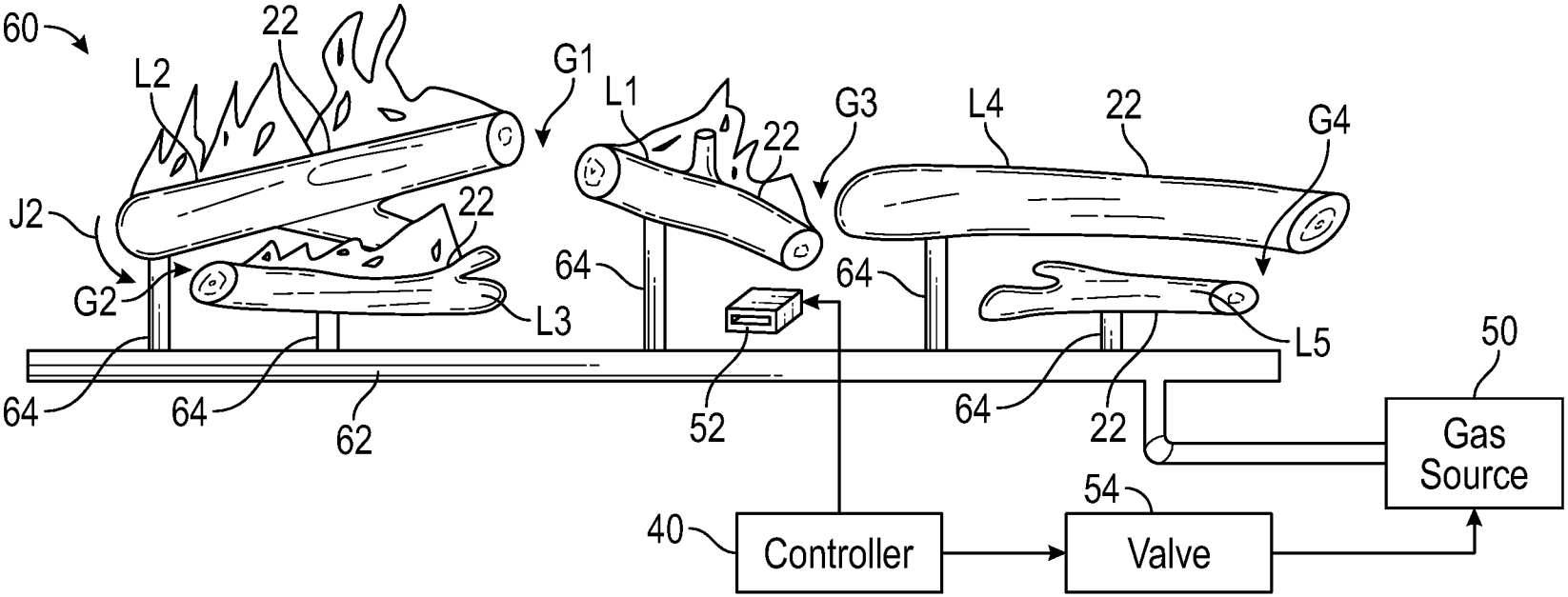

At block 66, after a second period of time, such as 0.3 seconds, the flame 18 of faux log L2 communicates through a conduit extending within the length of the body of faux log L2 and ignites gas supplied via respective conduit 64 of faux log L3 by jumping the gap extending between ends of these logs, shown a gap G2, to ignite faux log 13. This flame jumping is visually shown at J2 in FIG. 5C. The second time period is determined by the spacing distance between faux log L2 and faux log L3.

Figure 5D:
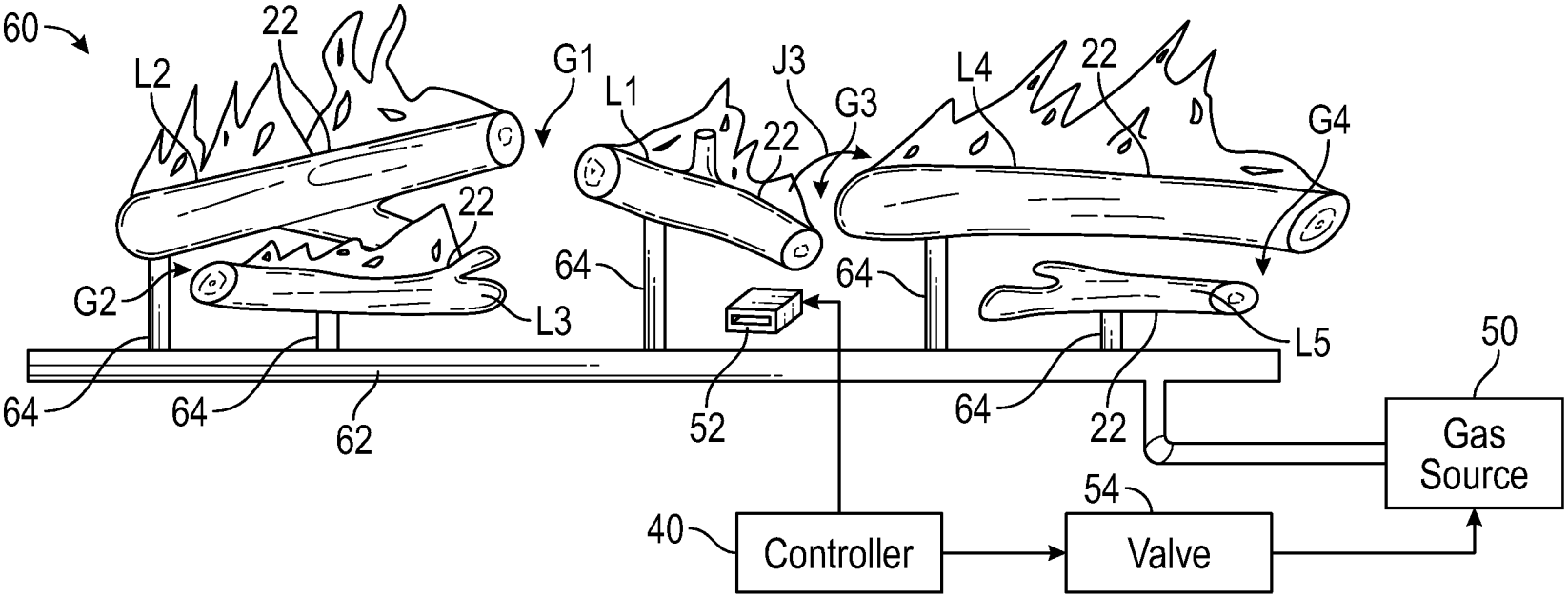

At block 68, after a third time period, such as 0.5 seconds, the flame 18 of faux log L1 communicates through a conduit extending within a length of faux log L1 and ignites gas supplied via respective conduit 64 of faux log L4 by jumping a gap G3 extending between ends of faux log L1 to faux log L4, thereby igniting faux log L4. This flame jumping is visually shown at J3 in FIG. 5D. The time delay between lighting faux log L1, L2, L3 and L4 is because the spacing distance between faux log L1 and faux log L4 is larger than the spacing distance between faux log L1 and faux log L2, such that gas from faux log L1 takes longer to reach faux log L4 than faux log L2.

Figure 5E:
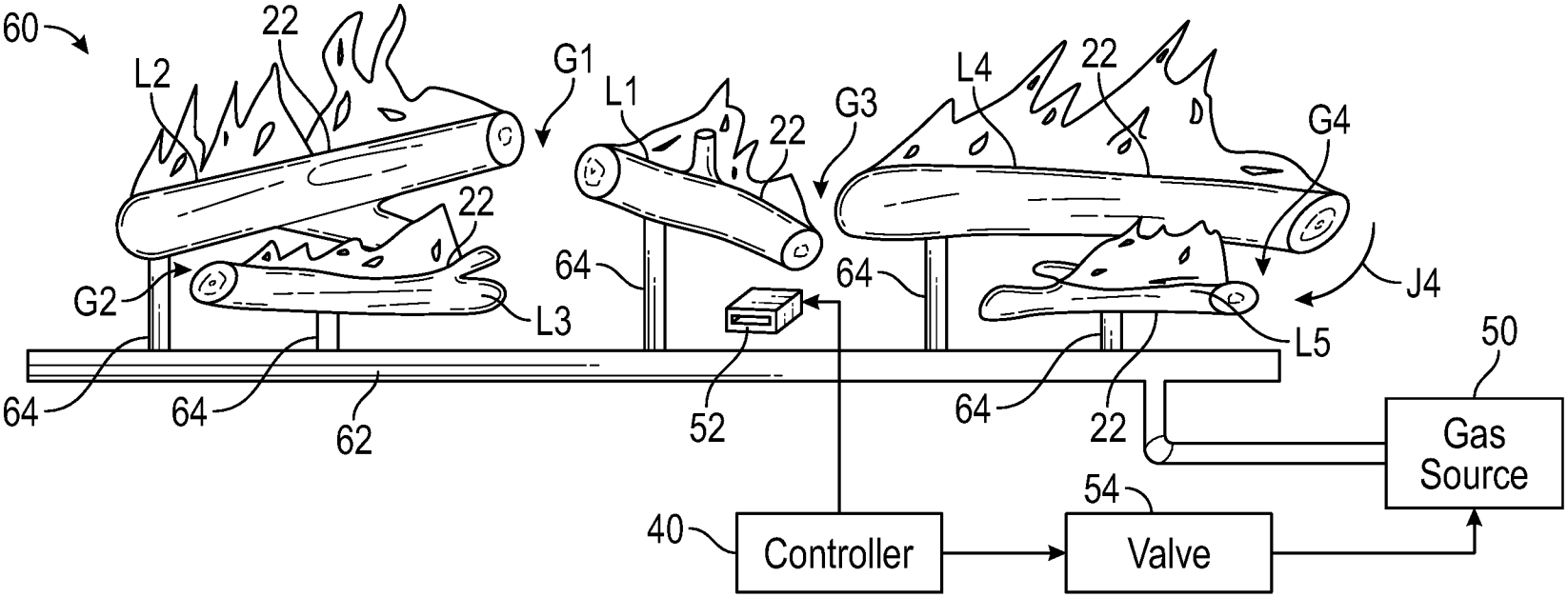

At block 70, after a fourth period of time, such as 0.3 seconds, the flame 18 of faux log L4 communicates through a respective conduit extending within the length of the body of faux log LA and ignites gas supplied via respective pipe 64 of log L5 by jumping the gap between ends of these logs, shown a gap G4, to ignite faux log L5. This flame jumping is visually shown at J4 in FIG. 5E.

This sequence only uses one flame ignitor 52 and creates an aesthetically pleasing faux log lighting sequence. The sequential lighting of faux logs 16 also creates a pleasing sound.

The center faux log L1 is lit first, such that the left faux logs L2 and L3 are lit thereafter, and such that the right faux logs L4 and L5 are lit after faux logs L2 and L3 are lit. This arrangement creates the lighting sequence described.

Other variations of this design include designing the gap distances between the faux logs such that faux log L4 is lit before faux log 13 is lit. In another variation, faux log L5 is lit before faux log L3 is lit. In another variation, flame ignitor 52 is configured to light the faux logs from left to right, such that flame ignitor 52 is placed proximate faux log L2 which is lit first, and then faux log L3 is lit, then faux log L4 and then faux log L5. In another embodiment, the gaps can extend between sides of the faux logs, from an end of one faux log to a side of another faux log, and a combination thereof.

The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the invention defined by the appended claims.

What is claimed is:

1. A method of controlling a fireplace comprising a body, a plurality of faux logs disposed in the body, a control input, and a controller responsive to the control input and configured to sequentially light the plurality of faux logs, the method comprising:

the controller receiving the control input; and the controller sequentially lighting the plurality of faux logs, wherein a first of the plurality of faux logs is lit by an ignitor to create a flame, wherein the flame of the first faux log lights a second and a third of the plurality of faux logs by first jumping a gap defined between the first and second faux logs and thereafter the flame jumping a gap defined between the first and the third faux logs, wherein the first of the plurality of logs is positioned between the second and the third of the plurality of logs;

wherein a fourth of the plurality of faux logs is lit by a flame of the second faux log before the third faux log is lit, wherein the second faux log is positioned between the first and fourth faux logs such that the second and fourth faux logs positioned to the left of the first faux log are lit first, and such that the third faux log is positioned to the right of the first faux log and lit after the fourth faux log.

2. The method as specified in claim 1, further comprising only a single ignitor responsive to the controller and lighting the plurality of faux logs.

3. The method as specified in claim 1, further comprising a gas source individually coupling gas to the first, second, third and fourth faux logs through dedicated conduits coupled to the respective first, second, third and fourth faux logs.

4. The method as specified in claim 3, wherein the conduits support the respective faux log.

5. The method as specified in claim 4, further comprising media disposed under the plurality of faux logs, wherein conduits extend through the media.

6. The method as specified in claim 1, wherein a fifth faux log is lit by the fourth faux log, wherein the third faux log is positioned between the first and fifth faux logs, wherein the third and fifth faux logs positioned right of the first faux log are lit after the second and fourth faux logs positioned to left of the first faux log are lit.

7. A fireplace, comprising:

a body;

a plurality of faux logs disposed in the body;

a control input; and a controller responsive to the control input and configured to sequentially light the plurality of faux logs, wherein a first of the plurality of faux logs is configured to be lit by an ignitor to create a flame, wherein the flame of the first faux log is configured to light a second and a third of the plurality of faux logs by first jumping a gap defined between the first and the second faux logs and thereafter the flame jumping a gap defined between the first and the third faux logs, wherein the first of the plurality of logs is positioned between the second and the third of the plurality of logs;

wherein a fourth of the plurality of faux logs is configured to be lit by a flame of the second faux log before the third faux log is lit, wherein the second faux log is positioned between the first and fourth faux logs such that the second and fourth faux logs positioned to the left of the first faux log are lit first, and such that the third faux log is positioned to the right of the first faux log and lit after the fourth faux log.

8. The fireplace as specified in claim 7, further comprising only a single ignitor responsive to the controller and configured to light the plurality of faux logs.

9. The fireplace as specified in claim 7, further comprising a gas source configured to individually couple gas to the first, second, third, and fourth faux logs through dedicated conduits coupled to the respective first, second, third, and fourth faux logs.

10. The fireplace as specified in claim 9, wherein the conduits are configured to support the respective faux log.

11. The fireplace as specified in claim 10, further comprising media disposed under the plurality of faux logs, wherein conduits extend through the media.

12. The fireplace as specified in claim 7, wherein the gap is defined between ends of the first and second faux logs.

13. The fireplace as specified in claim 7, wherein a fifth faux log is configured to be lit by the fourth faux log, wherein the third faux log is positioned between the first and fifth faux logs, wherein the third and fifth faux logs positioned right of the first faux log are configured to be lit after the second and fourth faux logs positioned to left of the first faux log.

14. The fireplace as specified in claim 7, wherein the control input is a remote control.

* * * * *